US008509663B2

(12) United States Patent
Asami et al.

(10) Patent No.: US 8,509,663 B2
(45) Date of Patent: Aug. 13, 2013

(54) IMAGE FORMING APPARATUS OR TRANSFER ROLLER USED IN IMAGE FORMING APPARATUS

(75) Inventors: Jun Asami, Susono (JP); Eiji Uekawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 12/904,948

(22) Filed: Oct. 14, 2010

(65) Prior Publication Data

US 2011/0116844 A1 May 19, 2011

(30) Foreign Application Priority Data

Nov. 17, 2009 (JP) ..... 2009-262069

(51) Int. Cl.
*G03G 15/16* (2006.01)

(52) U.S. Cl.
USPC ..... 399/313; 399/303

(58) Field of Classification Search
USPC ..... 399/313, 303
See application file for complete search history.

(56) References Cited

U.S. PATENT DOCUMENTS 4,014,606 A * 3/1977 Seanor et al. ..... 399/313
2008/0232867 A1* 9/2008 Minbu et al. ..... 399/313

FOREIGN PATENT DOCUMENTS

JP 08-050426 A 2/1996
JP 10-156841 A 6/1998
JP 11-119570 A 4/1999
JP 11-327328 A 11/1999
JP 2007-155809 A * 6/2007
JP 2008-298855 A 12/2008

OTHER PUBLICATIONS

Machine translation of JP 10-156841 dated Nov. 26, 2012.*
Machine translation of JP 11-119570 dated Nov. 26, 2012.*
Machine translation of JP 11-327328 dated Nov. 26, 2012.*
Machine translation of JP 2008-298855 dated Nov. 26, 2012.*

* cited by examiner

*Primary Examiner* — Sophia S Chen
(74) *Attorney, Agent, or Firm* — Canon USA Inc. IP Division

(57) ABSTRACT

An image forming apparatus includes a transfer roller. The transfer roller includes an elastic layer disposed on a metal core bar. The elastic layer is made of a non-foamed solid rubber. The surface of the elastic layer includes a plurality of convex portions extending in a line in the axis direction of the transfer roller.

20 Claims, 8 Drawing Sheets

IMAGE FORMING APPARATUS OR TRANSFER ROLLER USED IN IMAGE FORMING APPARATUS

BACKGROUND OF THE INVENTION

1. Field of the Invention

The present invention relates to an electrophotographic image forming apparatus, such as a laser printer or a copier, or a transfer roller used in an image forming apparatus.

2. Description of the Related Art

In an electrophotographic image forming apparatus, a latent image is formed on a photosensitive drum serving as an image bearing member. The latent image is developed using toner. The developed toner image is electrostatically transferred from the photosensitive drum to a transfer medium in a transfer nip portion formed by the photosensitive drum and a transfer roller.

In general, such a transfer roller used in an image forming apparatus is manufactured by forming a foaming sponge layer around a metal core bar serving as a shaft. The foaming sponge layer functions as a resistive layer or an elastic layer. Since a transfer roller of the foaming sponge type has a soft and elastic surface, the transfer roller can uniformly maintain a transfer nip portion N in the length direction (the axis direction of the transfer roller) when the transfer nip portion N is formed by pressing either end of the transfer roller in the length direction.

However, when a transfer roller of the foaming sponge type is manufactured, a foaming step is required during manufacture. Immediately after the transfer roller is manufactured, the accuracy of the outer shape is nonuniform. In order to limit the outer shape of the transfer roller of the foaming sponge type to a predetermined size, a step of making the accuracy of the outer shape uniform by polishing the surface of the transfer roller is required.

To solve such a problem, Japanese Patent Laid-Open No. 2008-298855 describes a method for employing a solid transfer roller as a transfer roller 5. The solid transfer roller has a surface layer made of a solid rubber formed from a non-foaming rubber, a resin, or a mixture of a non-foaming rubber and a resin. During a manufacturing stage, an error in the accuracy of the outer shape is less likely to occur for a solid transfer roller than for a transfer roller of the foaming sponge type. Thus, the outer shape of a solid transfer roller is easily formed to have a predetermined size.

However, when a solid transfer roller is employed, the following problem arises. Since a solid transfer roller has a hardness higher than that of a transfer roller of the foaming sponge type, it is difficult to ensure that the transfer nip portion N has a wide width in the rotation direction of the transfer roller along the length direction of the transfer roller. This is because the elastic layer of a solid transfer roller that has a hardness higher than that of a transfer roller of the foaming sponge type does not easily collapse even when the same pressure force is applied. Accordingly, as compared with a transfer roller of the foaming sponge type, the entire width of the transfer nip portion N of a solid transfer roller tends to be small along the length direction. In particular, the middle area of the transfer nip portion N in the length direction may be too narrow with respect to the end areas of the transfer nip portion N. In such a case, a desired electrical current does not flow in the middle area of the transfer nip portion N and, therefore, the color density of an image in the middle area tends to be lower than that in the end areas.

SUMMARY OF THE INVENTION

Accordingly, the present invention provides an image forming apparatus in which a transfer roller using a solid rubber for the elastic layer thereof is capable of ensuring that a transfer nip formed when the transfer roller is urged against a photoconductor drum has a uniform wide width along the length direction of the transfer roller.

According to an embodiment of the present embodiment, an image forming apparatus includes an image bearing member configured to bear a toner image and a transfer roller configured to face the image bearing member and form a transfer nip portion together with the image bearing member. The image forming apparatus transfers the toner image from the image bearing member onto a transfer medium conveyed into the transfer nip portion. The transfer roller includes a metal core bar and an elastic layer disposed on the metal core bar. The elastic layer is formed of solid rubber which does not foam by a foaming process, and the elastic layer includes, on a surface thereof, a plurality of convex portions each extending in a line in an axis direction of the transfer roller.

According to another embodiment of the present embodiment, a transfer roller for use in an image forming apparatus is provided. The image forming apparatus includes an image bearing member configured to bear a toner image and the transfer roller configured to face the image bearing member and form a transfer nip portion together with the image bearing member. The transfer roller transfers a toner image from the image bearing member onto a transfer medium conveyed to the transfer nip. The transfer roller includes a metal core bar and an elastic layer disposed on the metal core bar and formed of solid rubber which does not foam by a foaming process. The elastic layer includes, on a surface thereof, a plurality of convex portions each extending in a line in an axis direction of the transfer roller.

Further features of the present invention will become apparent from the following description of exemplary embodiments with reference to the attached drawings.

DESCRIPTION OF THE EMBODIMENTS

Exemplary embodiments of the present invention are described in detail below with reference to the accompanying drawings. It should be noted that the dimensions, the materials, the shapes, and the relative positions of components described in the exemplary embodiments can be appropriately changed in accordance with the configuration and a variety of conditions of apparatuses according to the present invention.

First Embodiment

Figure 1:
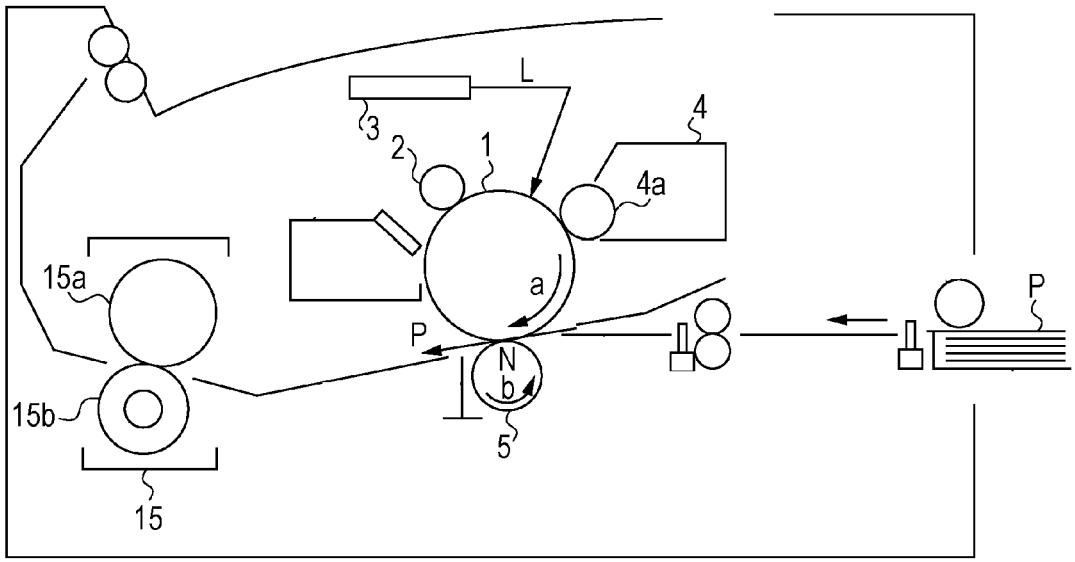
FIG. 1 is a schematic illustration of an exemplary configuration of an image forming apparatus according to a first embodiment of the present invention.

FIG. 1 is a schematic illustration of an example of an electrophotographic image forming apparatus according to a first embodiment of the present invention. A photosensitive drum 1 serving as an image bearing member is rotatingly driven in a direction indicated by an arrow a at predetermined process speed. A charge roller 2 is in contact with a surface of the photosensitive drum 1 under a predetermined pressure. Thus, the charge roller 2 charges the photosensitive drum 1 by using a charging voltage applied from a charging power supply (not shown) so that the photosensitive drum 1 has a predetermined polarity and a predetermined potential. An exposure unit 3 emits a laser beam L controlled in accordance with input image information and scans the surface of the photosensitive drum 1 uniformly charged by the charge roller 2 in a direction perpendicular to the rotational direction. Thus, the surface is exposed to the laser beam L. Through the exposure, an electrical charge in an area scanned by the laser beam L is discharged. In this way, an electrostatic latent image is formed on the surface of the photosensitive drum 1. A development unit 4 attaches toner to the electrostatic latent image formed on the surface of the photosensitive drum 1 at a development location and forms a toner image. Thus, the image is developed (i.e., visualized).

A transfer roller 5 serving as a transferring member is in contact with a surface of the photosensitive drum 1 under a predetermined pressure. Thus, a transfer nip portion N is formed. In the transfer nip portion N formed between the photosensitive drum 1 and the transfer roller 5, the transfer roller 5 transfers the toner image formed on the surface of the photosensitive drum 1 to a transfer medium P by using a transfer voltage applied from a transfer power supply (not shown). The transfer roller 5 is rotated in a direction indicated by an arrow b (in a counterclockwise direction). A fuser unit 15 includes a fuser roller 15*a* and a pressure roller 15*b*. The fuser unit 15 applies heat and pressure to the transfer medium P having the toner image transferred thereon between the fuser roller 15*a* and the pressure roller 15*b*. Thus, the toner image is heat-fixed to a surface of the transfer medium P.

Figure 2A:
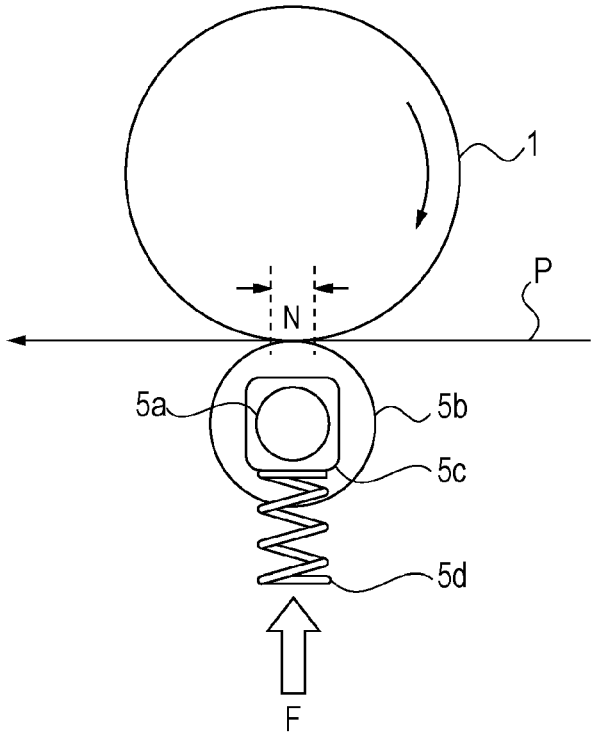
FIGS. 2A and 2B are cross-sectional views of a transfer roller according to the first embodiment.
Figure 2B:
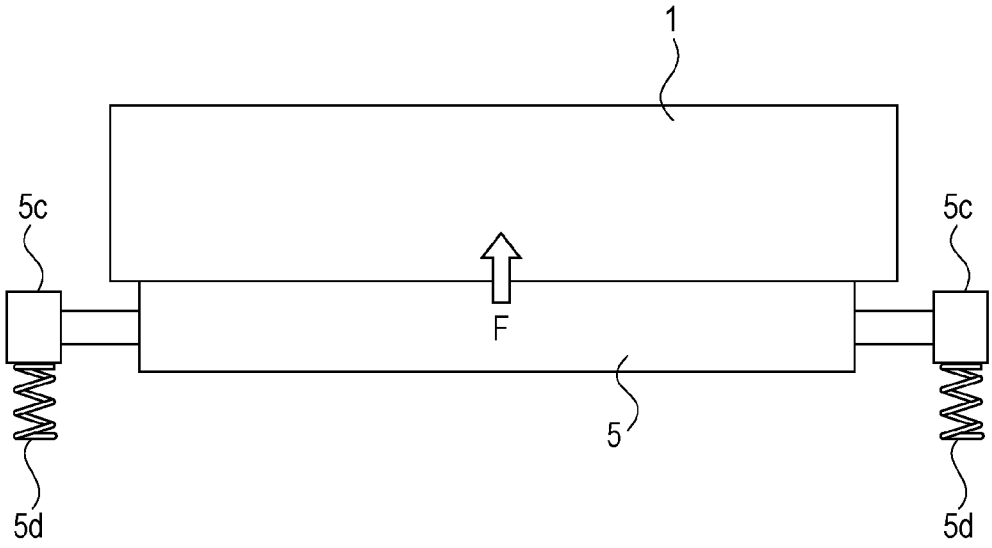

The transfer roller 5 is described next. According to the present embodiment, as shown in FIGS. 2A and 2B, the transfer roller 5 includes a metal core bar 5*a* and an elastic layer 5*b*. More specifically, the elastic layer 5*b* having a thickness of 3.75 mm is formed on the metal core bar 5*a* having a diameter of 5 mm. The external diameter of the transfer roller 5 is 12.5 mm. The size of the transfer roller 5 in the length direction (the axis direction) is 218 mm. The resistive value of the transfer roller 5 is higher than or equal to $1\times10^8\Omega$ and lower than or equal to $3\times10^8\Omega$. In addition, either end portion of the transfer roller 5 is in pressure contact with the photosensitive drum 1 by a pressure force F (540 gf (0.54×9.807 N), and a total pressure of 1080 gf (1.08×9.807 N)) generated by a pressure spring 5*d* and received from the metal core bar 5*a* via a shaft bearing 5*c*. Thus, the transfer nip portion N is formed. Since the pressure force F is applied to either end of the transfer roller 5, the middle portion of the transfer nip portion N tends to be narrower than the end portion in the length direction of the transfer roller 5. Note that in the image forming apparatus according to the present embodiment, by setting the pressure force F to a value in the range from 0.54×9.807 N to 1.08×9.807 N, the transfer medium P can be conveyed in the transfer nip portion N without any problem.

The elastic layer 5*b* of the transfer roller 5 is formed of, for example, a solid rubber including an ethylene-propylene rubber (EPDM), a polypropylene resin (PP), and an ion-conductive material. As used herein, the term "solid rubber" refers to a non-foamed elastic material that is manufactured without a foaming step.

A material used as a solid rubber is formed by dispersing a cross-linkable component (B), such as rubber, in a component (A), such as a thermoplastic resin or a thermoplastic elastomer, using dynamic cross linking and, subsequently, mixing an ion-conductive material (C) with the components (A) and (B).

More specifically, a thermoplastic hydrogenated styrenic elastomer that has an excellent resistance to climate is suitable for the component (A). In particular, a styrene-ethylene-ethylene/propylene-styrene (SEEPS) copolymer that has a high rupture strength when molded and appropriate stretching properties is suitable. Alternatively, a styrene-ethylene/propylene-styrene (SEPS) copolymer or a styrene-ethylene/butylene-styrene (SEBS) copolymer can be used. In addition to the styrene-based material, a variety of thermoplastic elastomers, such as a polyolefin-based, polyester-based, polyamide-based, or polyurethane-based thermoplastic elastomer can be used.

In addition, a rubber component consisting primarily of an ethylene-propylene rubber (EPDM) is suitable for the component (B). A rubber component other than EPDM may be blended together. Examples of the rubber component other than EPDM include a diene rubber, such as a chloroprene rubber (CR), a natural rubber (NR), a butadiene rubber (BR), a styrene-butadiene rubber (SBR), an isoprene rubber (IR), an acrylonitrilebutadiene rubber (NBR), or a hydrogenated nitrile rubber (HNBR). One or two or more rubbers may be mixed together.

An ion-conductive antistatic agent including metallic salt is suitable for the component of an ion-conductive material (C). The materials and the loadings of the materials are selected in accordance with a required characteristic of a resistive value of the transfer roller 5, such as the environment characteristic or the conduction characteristic. In addition, an additive agent related to the loading is adjusted, and a loading process is appropriately performed. Subsequently, the materials are kneaded. Alternatively, an ion-conductive agent may be added to a commercially available compound including one of a variety of thermoplastic elastomers having a dynamically cross-linkable rubber component dispersed therein and may be kneaded. Still alternatively, one of a variety of conductive agent is added to a conductive elastomer compound and may be kneaded.

The above-described materials are formed into the transfer roller 5 through the following steps. By using a twin-screw extruder, a thermoplastic elastomer serving as the component (A) and a dynamically cross-linkable rubber are kneaded. In addition, in order to facilitate the cross-link of the rubber by using a softener, such as oil or a plasticizing agent, and application of heat during a kneading process, a cross-linking resin agent, such as a phenol resin, is added to the materials. Thereafter, the materials are kneaded for a predetermined period of time. In this way, dynamic cross-link is facilitated. Thereafter, the material is cooled and extracted in the form of pellets. Subsequently, these pellets are moved into a single axis extruder together with a variety of ion-conductive agents. Thereafter, the ion-conductive agents are sufficiently dispersed. The material is extruded through a die. While this example has been described with reference to the case in which ion-conductive agents are mixed during extrusion molding, the ion-conductive agents may be kneaded in a different step in advance.

As described above, according to the present embodiment, the solid rubber is an elastic member produced through steps without a step of mixing blowing agents into the material and foaming the material in a molding stage.

A desired outer shape can be obtained without polishing the surface of the solid rubber produced through extrusion molding.

Figure 3A:
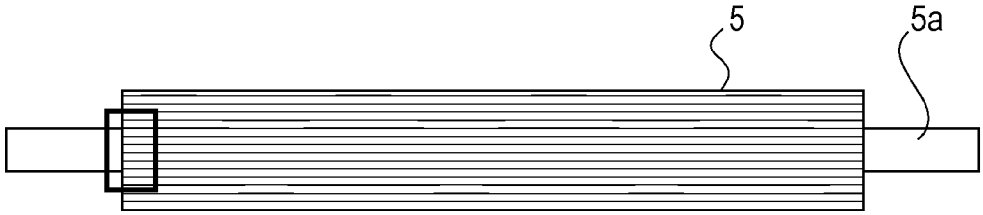
FIGS. 3A and 3B are schematic illustrations of an exemplary structure of the transfer roller according to the first embodiment.
Figure 3B:
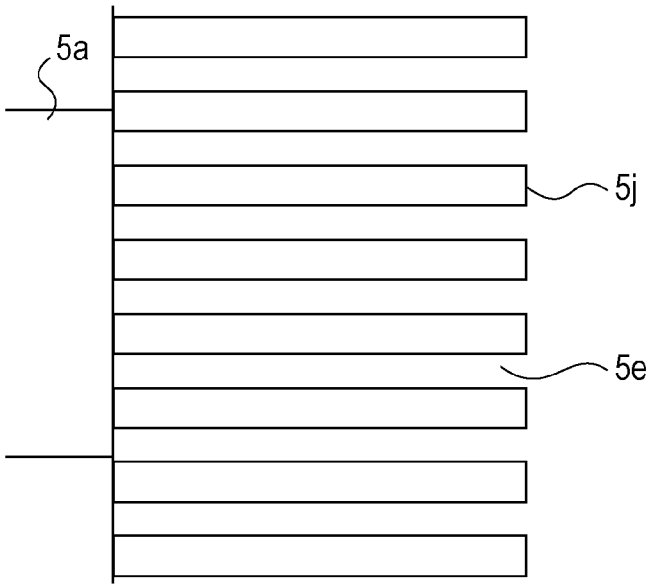

As shown in FIG. 3A, the surface of the transfer roller 5 has concave portions 5*e* and convex portions 5*j*. According to the present embodiment, by providing the concave portions 5*e* and the convex portions 5*j* each linearly extending in the length direction, the transfer nip portion N having an appropriate width can be provided along the length direction. Note that the surface of the transfer roller 5 between the neighboring convex portions 5*j* may serve as one of the concave portions 5*e*. Alternatively, the surface of the transfer roller 5 between the neighboring concave portions 5*e* may serve as one of the convex portions 5*j*.

Since each of the convex portions 5*j* of the transfer roller 5 bows in the transfer nip portion N in the rotational direction of the photosensitive drum 1, the width of even the middle area of the transfer nip portion N can be maintained. The reason for this is as follows. The convex portion 5*j* bows in the transfer nip portion N during formation of an image. That is, the convex portion 5*j* is not linearly bent with respect to the surface of the photosensitive drum 1, but is bent into a curved shape (i.e., the convex portion 5*j* bows). By designing the convex portion 5*j* so that the convex portion 5*j* bows, the hardness of a portion of the solid rubber that is brought into contact with the photosensitive drum 1 or the transfer medium P, that is, a portion that is used for a transfer operation, can be decreased. In addition, the contact area of the bowing convex portion 5*j* with the photosensitive drum 1 or the transfer medium P can be made larger than the contact area of the convex portion 5*j* that does not bow. As a result, the width of the transfer nip portion N can be ensured even in the middle area in the length direction.

The top portion of the convex portion 5*j* may have a sharp edge or may have a trapezoidal shape. Such a shape of the top portion can be formed by providing a concavo-convex inner surface to a die of an extruder and extruding the material through the die during a manufacturing step.

Figure 4A:
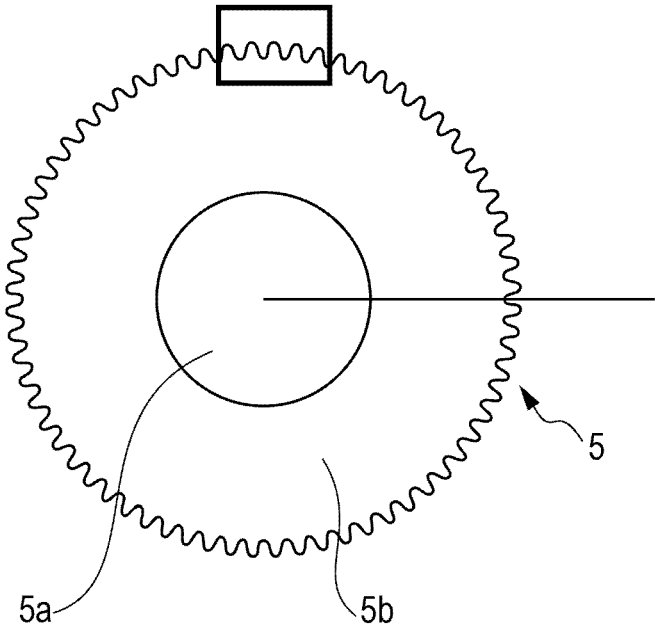
FIGS. 4A and 4B are cross-sectional views of an elastic layer of the transfer roller according to the first embodiment.
Figure 4B:
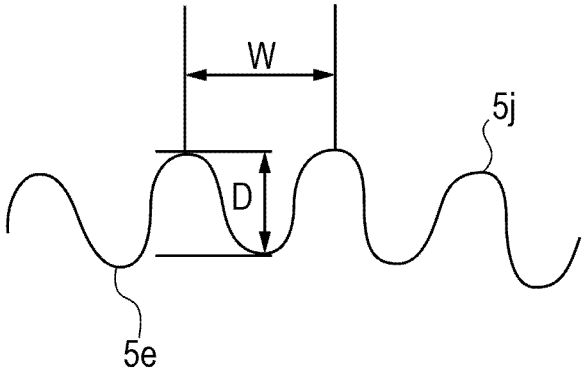

FIG. 4A is a cross-sectional view of the transfer roller 5 in a direction perpendicular to the length direction of the transfer roller 5. FIG. 4B is a partially enlarged view of FIG. 4A. A width W in FIG. 4B represents a center-to-center distance between two neighboring convex portions. A depth D in FIG. 4B is a length from the bottom of a concave portion to a tangential line of the vertex of the convex portion. The depth D and the width W of the transfer roller 5 can be measured by using, for example, a commercially available laser microscope.

More specifically, the depth D and the width W can be measured by using a Real Color Confocal Microscope Optelics C130 available from Lasertec Corporation. By using such a laser microscope with a predetermined magnification factor, the depth D of a neighboring concave portion and convex portion and the width W can be measured in the measurement field of view. According to the present embodiment, measurement was made 10 times, and the average of the measurement values was used.

Table 1 shows a relationship among the width W and depth D of the concavo-convex portion and the hardness of the surface of the transfer roller 5. The measurement was made using an Asker C hardness tester (under a load of 1 kg) and JIS-K7312.

TABLE 1

| DEPTH D | WIDTH W (μm) | | | | | | |
|---|---|---|---|---|---|---|---|
| (μm) | 50 | 100 | 300 | 400 | 500 | 800 | 1000 |
| 50 | 75° | 77° | 78° | 78° | 78° | 79° | 80° |
| 100 | 70° | 73° | 76° | 77° | 78° | 78° | 78° |
| 300 | 65° | 70° | 72° | 75° | 77° | 78° | 78° |
| 500 | 60° | 65° | 70° | 72° | 74° | 77° | 78° |
| 700 | 55° | 60° | 64° | 70° | 73° | 75° | 77° |
| 1000 | 50° | 55° | 60° | 65° | 68° | 73° | 76° |
| 1500 | 45° | 50° | 55° | 60° | 65° | 70° | 75° |

As can be seen from Table 1, as the width of the concavo-convex portion decreases or the depth D increases, the hardness of the roller decreases.

Figure 5A:
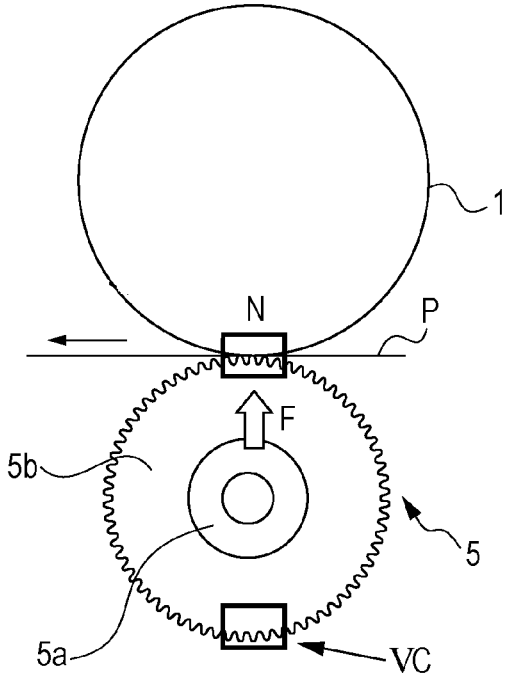
FIGS. 5A to 5C are schematic illustrations of a concavo-convex portion according to the first embodiment.
Figure 5B:
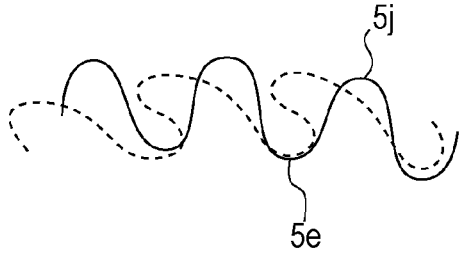
Figure 5C:
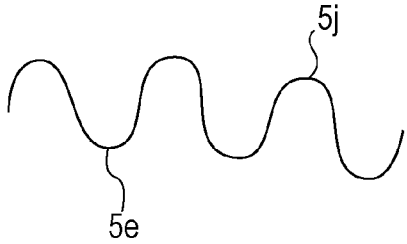

The reason for this is described next with reference to FIGS. 5A to 5C and FIG. 6. FIG. 5B is an enlarged view of the transfer nip portion N shown in FIG. 5A. FIG. 5C is an enlarged view of FIG. 5A excluding the transfer nip portion N. As shown in FIG. 5C, the convex portion 5*j* extends vertically. As shown in FIG. 5B, in the transfer nip portion N, the transfer roller 5 presses against the photosensitive drum 1 and, therefore, the transfer roller 5 receives a reaction force from the photosensitive drum 1. If the width W is small and the depth D is large, the convex portion 5*j* significantly bows about the base portion thereof in the rotational direction of the photosensitive drum 1 due to the reaction force received from the photosensitive drum 1. Accordingly, as the width of the concavo-convex portion decreases or the depth D increases, the amount of curvature of the convex portion 5*j* increases. Thus, the hardness of the portion of the transfer roller 5 having a concavo-convex portion used for a transfer operation can be lower than that of the transfer roller 5 having no concavo-convex portion.

A direction in which the convex portion 5*j* bows varies in accordance with a relationship between peripheral speeds of the transfer roller 5 and the photosensitive drum 1 facing the transfer roller 5. Let Vt denote the peripheral speed of the transfer roller 5, and Vd denote the peripheral speed of the photosensitive drum 1. If Vt<Vd, the convex portion 5*j* tends to bow in a direction that is the same as the rotational direction of the photosensitive drum 1. However, if Vt>Vd, the convex portion 5*j* tends to bow in a direction opposite to the rotational direction of the transfer roller 5. If Vt=Vd, the convex portion 5*j* is negligibly affected by the rotational force. Thus, the convex portion 5*j* may bow in either direction.

Figure 6:
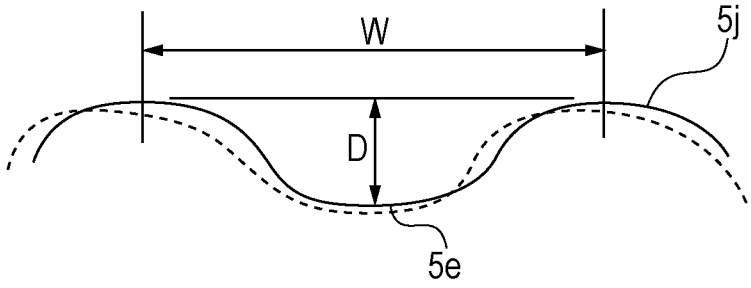
FIG. 6 is a schematic illustration of a concavo-convex portion according to the first embodiment.

As shown in FIG. 6, if the depth D is too small, the pressure force F cannot make the convex portion 5*j* bow. Thus, the hardness of the portion used for a transfer operation negligibly decreases. In FIG. 6, the convex portion 5*j* shown as a dotted line represents the convex portion 5*j* that does not bow by the pressure force F.

Figure 7:
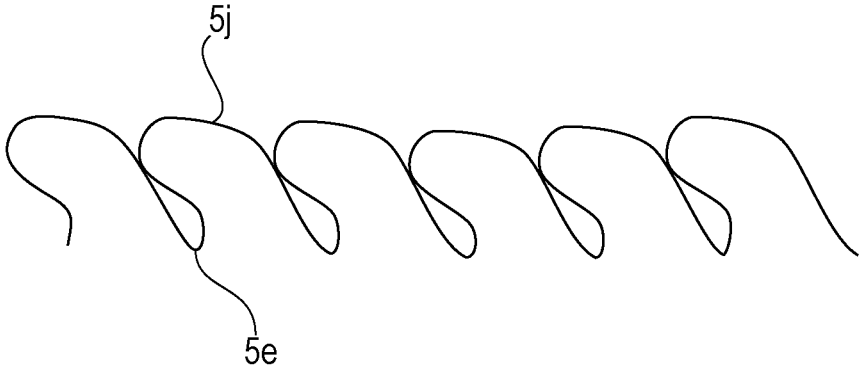
FIG. 7 is a schematic illustration of convex portions that are bowing according to the first embodiment.

When a relationship between the width W and the depth D of the concavo-convex portion is in a certain range, a contact area of the convex portion 5*j* with the photosensitive drum 1 or the transfer medium P increases under the pressure due to the pressure force F. Accordingly, a sufficient transfer nip portion N in the middle of the transfer roller 5 in the length direction can be provided. FIG. 7 illustrates an ideal tilt state of the convex portion 5*j* in which the convex portion 5*j* is tilted so as to be in contact with the neighboring convex portion 5*j*.

Table 2 indicates a relationship between a shape of the concavo-convex portion (a relationship between the depth D and the width W) and the transferability of the transfer roller 5 in the middle portion with respect to the end portion in the length direction.

In this experiment, a solid image was printed on the transfer medium P. The color density in the middle portion in the length direction was compared with that in the end portion. If it was determined that the densities in the middle portion and the end portion was the same, "o" (suitable) was given. However, if it was determined that the color density in the middle portion was obviously lower than that in the end portion, "x" (unsuitable) was given. The phenomenon in which the color density in the middle portion is obviously lower than that in the end portion is referred to as "defective transfer of the center". Note that this experiment was conducted using a printer having a process speed of 150 mm/sec and 26 sheets/min (when an A4 sheet is longitudinally fed).

TABLE 2

| DEPTH D | WIDTH W (μm) | | | | | |
|---|---|---|---|---|---|---|
| (μm) | 50 | 100 | 300 | 500 | 800 | 1000 |
| 50 | ○ | X | X | X | X | X |
| 100 | ○ | ○ | X | X | X | X |
| 300 | ○ | ○ | ○ | X | X | X |
| 500 | ○ | ○ | ○ | ○ | X | X |
| 700 | ○ | ○ | ○ | ○ | ○ | ○ |
| 1000 | ○ | ○ | ○ | ○ | ○ | ○ |
| 1100 | ○ | ○ | ○ | ○ | ○ | ○ |

As can be seen from Table 2, as the width of the concavo-convex portion is decreased or the depth D is increased, defective transfer of the center occurs less frequently. In addition, it can be seen that it is desirable that D/W≧0.7.

The reason for this is as follows. If D/W≧0.7, the state shown in FIG. 7 occurs. That is, the state in which one of the convex portions 5*j* is tilted to the position at which the convex portion 5*j* is in contact with the neighboring convex portion 5*j* occurs. This state decreases the hardness of the portion used for a transfer operation and maximizes the contact area of the transfer roller 5 with the photosensitive drum 1 or the transfer medium P. Thus, this state excellently prevents the occurrence of defective transfer of the center.

In addition, as can be seen from Tables 1 and 2, when D/W≧0.7, the hardness of the transfer roller 5 (Asker C under a load of 1 kg) is higher than or equal to 45 degrees and lower than or equal to 75 degrees.

Furthermore, in the relationship between the width W and the depth D, it is desirable that the maximum value of the width W be restricted in addition to the condition: D/W≧0.7.

Figure 8A:
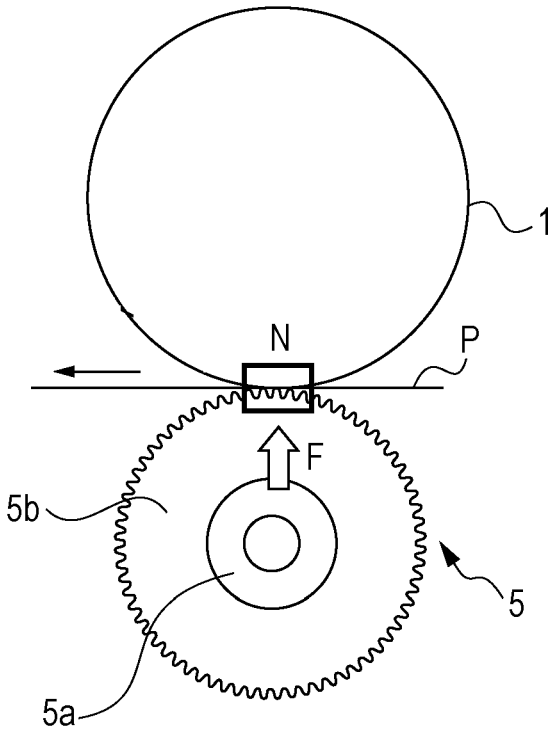
FIGS. 8A and 8B are schematic illustrations of a relationship between a transfer medium and the convex portion according to the first embodiment.
Figure 8B:
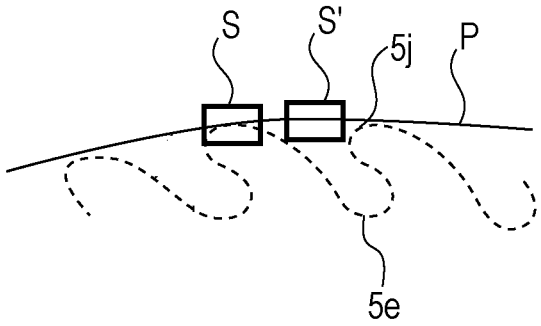

FIGS. 8A and 8B illustrate the transfer medium P being pinched and conveyed in the transfer nip portion N. FIG. 8B is an enlarged view of the transfer nip portion N shown in FIG. 8A. The transfer medium P is pinched and conveyed between the transfer roller 5 and the photosensitive drum 1 while being in pressure contact with the transfer roller 5 and the photosensitive drum 1 by the pressure force F. The rotation of the transfer roller 5 and the photosensitive drum 1 conveys the transfer medium P. The transfer medium P is in contact with the convex portions 5*j* of the transfer roller 5 and is not in contact with the concave portions 5*e*. A transfer electrical current flows from the transfer roller 5 to an area S of the transfer medium P that is in contact with the convex portions 5*j* of the transfer roller 5. Thus, electrical charge having a polarity that is opposite to that of the toner is applied to the area S. In contrast, discharge occurs in the nip between the transfer roller 5 and an area S' of the transfer medium P that is not in contact with the transfer roller 5. As a result, electrical charge having a polarity that is opposite to that of the toner is applied to the area S'. However, if a distance d between the transfer medium P and the convex portion 5*j* is too large, the amount of discharge to the area S' is significantly decreased and, therefore, a sufficient amount of electrical charge cannot be applied to the transfer medium P. At that time, if the width W is too large, the distance between the transfer medium P and any one of the convex portions 5*j* is also too large. Thus, there is a point at which a sufficient amount of electrical charge cannot be applied to the transfer medium P (lack of a transfer current). At such a point at which the transfer current is insufficient, it is difficult to sufficiently transfer a toner image to the transfer medium P.

As a result, an area in which toner is not sufficiently transferred from the photosensitive drum 1 to the transfer medium P periodically appears in the rotational direction of the transfer roller 5. Accordingly, a non-uniform color density image having periodical horizontal streaks is generated. In the experiment, if it was determined through visual inspection that a non-uniform color density image caused by the concavo-convex shape was not generated, "o" (suitable) was given. However, if it was determined through visual inspection that even a slight non-uniform color density image was generated, "x" (unsuitable) was given. Note that this experiment was conducted using a printer having a process speed of 150 mm/sec and 26 sheets/min (when an A4 sheet is longitudinally fed).

TABLE 3

| DEPTH D | WIDTH W (μm) | | | | | | |
|---|---|---|---|---|---|---|---|
| (μm) | 50 | 100 | 300 | 400 | 500 | 800 | 1000 |
| 50 | ○ | ○ | ○ | ○ | ○ | ○ | ○ |
| 100 | ○ | ○ | ○ | ○ | ○ | ○ | ○ |
| 300 | ○ | ○ | ○ | ○ | ○ | ○ | ○ |
| 500 | ○ | ○ | ○ | ○ | ○ | ○ | X |
| 700 | ○ | ○ | ○ | ○ | ○ | ○ | X |
| 1000 | ○ | ○ | ○ | ○ | ○ | ○ | X |
| 1500 | ○ | ○ | ○ | ○ | ○ | ○ | X |

As can be seen from Table 3, when the width of the concavo-convex portion is larger than 800 μm, a non-uniform color density image caused by the concavo-convex shape is generated.

In the transfer roller 5, if the width W is larger than 800 μm, a distance between the neighboring convex portions 5*j* is too large even when the convex portions 5*j* bow due to application of the pressure force F in the transfer nip portion N. Therefore, a point at which sufficient electrical charge is not applied to the transfer medium P appears.

Consequently, in order to prevent the occurrence of defective transfer of the center and generation of a non-uniform color density image caused by the concavo-convex shape, it is desirable that the width W be smaller than or equal to 800 μm and the condition D/W≧0.7 be satisfied.

Furthermore, it is more desirable that the minimum values of the depth D and the width W be restricted in addition to the condition D/W≧0.7.

Further consideration indicates that when a solid image (a high color density image) is transferred to the entirety of a printable area of the transfer medium P, some toner may be deposited on the transfer roller 5. In particular, when the depth D and the width W are too small, the toner deposited on the transfer roller 5 may adhere to the transfer medium P that is subsequently conveyed into the transfer nip portion N. As a result, the back surface of the transfer medium P may be soiled or stained.

FIG. 4 illustrates a relationship between the shape of the concavo-convex portion and the toner stain on the surface of the transfer roller 5. In order to measure toner stain, a solid image having a length of 39.25 mm that is equal to the circumferential length of the transfer roller 5 was printed on the photosensitive drum 1. Subsequently, the solid image formed on the photosensitive drum 1 was in rotation contact with the transfer roller 5 without a paper sheet in the transfer nip portion N. In this way, the surface of the transfer roller 5 was stained. Thereafter, a cleaning bias having a polarity the same as that of the toner and a potential of −1 kV was applied to the transfer roller 5 for 5 seconds. Subsequently, the transfer medium P was printed. In this way, the level of toner stain adhering to the transfer medium P was measured. Note that this experiment was conducted using an image forming apparatus having a process speed of 150 mm/sec and 26 sheets/min (when an A4 sheet is longitudinally fed).

TABLE 4

| DEPTH D | WIDTH W (μm) | | | | | | |
|---|---|---|---|---|---|---|---|
| (μm) | 50 | 100 | 300 | 400 | 500 | 800 | 1000 |
| 50 | X | X | X | X | X | X | X |
| 100 | X | ○ | ○ | ○ | ○ | ○ | ○ |
| 300 | X | ○ | ○ | ○ | ○ | ○ | ◎ |
| 500 | X | ○ | ○ | ○ | ○ | ◎ | ◎ |
| 700 | X | ○ | ○ | ○ | ○ | ◎ | ◎ |
| 1000 | X | ○ | ○ | ○ | ◎ | ◎ | ◎ |
| 1500 | X | ○ | ○ | ○ | ◎ | ◎ | ◎ |

In the measurement of Table 4, if a stain is not observed by eye directly and with magnification using, for example, a magnifying glass, "◎" (optimal) was given. If a stain is not observed by eye directly, but a slight stain is detected by eye with magnification using, for example, a magnifying glass, "o" (suitable) was given. If any stain is observed by eye directly, "x" (unsuitable) was given. As can be seen from Table 4, a problem of toner stain does not arise if the width W is larger than or equal to 100 μm and the depth D is larger than or equal to 100 μm. In addition, as the width W is increased and the depth D is increased, the level of toner stain is decreased.

The toner particles deposited on the transfer medium P may enter the concave portion 5*e* formed on the surface of the transfer roller 5 or adhere to some points of the convex portion 5*j*. If the depth D and the width W are too small, the concave portion 5*e* does not contain all of the toner particles and, therefore, many toner particles are brought into contact with the transfer medium P. If the number of toner particles that are brought into contact with the transfer medium P increases, the transfer medium P is easily stained. By increasing the width W or the depth D, the transfer roller 5 can contain a large number of toner particles. As a result, the number of the toner particles that adhere to the transfer medium P can be reduced.

Therefore, in order to prevent a stain on the back surface of the transfer medium P, it is effective that the width W be larger than or equal to 100 μm and the depth D be larger than or equal to 100 μm.

As described above, according to the present embodiment, even in the case of the transfer roller 5 using a solid rubber as a non-foamed elastic member, the occurrence of defective transfer of the center can be prevented by using the transfer roller 5 having a plurality of convex portions that bow in the transfer nip portion N during formation of an image.

In addition, in order to sufficiently prevent the occurrence of defective transfer of the center by decreasing the hardness of the transfer roller 5 and increasing the contact area of the convex portion 5*j*, it is desirable that the condition D/W≧0.7 (where D denotes the width, and W denotes the depth) be satisfied. Furthermore, if the width W is smaller than or equal to 800 μm, the occurrence of defective transfer of the center can be prevented and generation of a non-uniform color density image caused by the concavo-convex shape can be prevented. Still furthermore, if each of the width W and the depth D is larger than or equal to 100 μm, a stain on the back surface of the transfer medium P can be prevented.

Accordingly, when the condition D/W≧0.7 (where D denotes the width, and W denotes the depth) is satisfied and if the width W is smaller than or equal to 800 μm and each of the width W and the depth D is larger than or equal to 100 μm, the occurrence of defective transfer of the center can be prevented. In addition, generation of a non-uniform color density image caused by the concavo-convex shape and a stain on the back surface of the transfer medium P can be prevented.

Second Embodiment

A transfer roller according to a second embodiment is described next. Note that the configuration of an image forming apparatus according to the second embodiment is similar to that of the first embodiment except for the depth D of a solid rubber of the surface layer of a transfer roller. Accordingly, the same reference numerals are used in both first and second embodiments to identify the same members.

Like the first embodiment, the transfer roller 5 receives the pressure force F caused by the pressure spring 5*d* from the metal core bars 5*a* at either end of the transfer roller 5 via the shaft bearing 5*c* in the length direction. Accordingly, the convex portion 5*j* in the end portion of the transfer roller 5 may be cracked, rolled, or damaged after the transfer roller 5 has been used for a long time. If part of the convex portion 5*j* that comes off by cracking adheres to the photosensitive drum 1 via the transfer roller 5, an image artifact may occur. Therefore, according to the present embodiment, the depth of the solid rubber is restricted, and the durability of the transfer roller 5 is improved.

Table 5 indicates a result of evaluation in terms of the durability of the convex portion 5*j* with respect to the shape of the concavo-convex portion. In order to evaluate the durability of the convex portion 5*j*, 75000 paper sheets, which corresponds to the lifetime of the image forming apparatus, were continuously printed using the transfer roller 5 first. Subsequently, the transfer roller 5 was visually inspected by eye directly and with magnification using, for example, a magnifying glass. In this way, cracking, bending, and damage of the convex portion 5*j* after the lifetime expired were observed. In addition, by using the transfer roller 5 after the lifetime expired, an image was generated. Note that this experiment was conducted using an image forming apparatus having a process speed of 150 mm/sec and 26 sheets/min (when an A4 sheet is longitudinally fed).

TABLE 5

| DEPTH D | WIDTH W (μm) | | | | | | |
|---|---|---|---|---|---|---|---|
| (μm) | 50 | 100 | 300 | 400 | 500 | 800 | 1000 |
| 50 | ○ | ○ | ○ | ○ | ○ | ○ | ○ |
| 100 | ○ | ○ | ○ | ○ | ○ | ○ | ○ |
| 300 | ○ | ○ | ○ | ○ | ○ | ○ | ○ |
| 500 | ○ | ○ | ○ | ○ | ○ | ○ | ○ |
| 700 | ○ | ○ | ○ | ○ | ○ | ○ | ○ |
| 1000 | ○ | ○ | ○ | ○ | ○ | ○ | ○ |
| 1100 | X | X | X | X | X | X | X |

In the evaluation indicated by Table 5, if a problem of the convex portion 5*j*, such as cracking, bending, and damage, is not observed by eye with magnification and the printed image is excellent, "o" (suitable) is given. However, if a problem of the convex portion 5*j* is observed or an image artifact is found, "x" (not suitable) is given. Table 5 indicates that the durability of the convex portion 5*j* is at a suitable level if at least the depth D of the concavo-convex portion is smaller than or equal to 1000 μm. Note that as the depth D of the concavo-convex portion is increased and the convex portion 5*j* more sharply protrudes, the durability decreases.

According to the present embodiment, the depth D is smaller than or equal to 1000 μm, and the convex portion 5*j* does not significantly sharply protrudes. Accordingly, the occurrence of cracking and damage of the convex portion 5*j* can be prevented during the lifetime.

Therefore, if the condition D/W≧0.7 (where D denotes the width, and W denotes the depth) is satisfied and the depth D is smaller than or equal to 1000 μm, the occurrence of defective transfer of the center can be sufficiently prevented. In addition, the durability can be improved. Furthermore, when the width W is smaller than or equal to 800 μm and the depth D is smaller than or equal to 1000 μm and if each of the width W and the depth D is larger than or equal to 100 μm, the occurrence of defective transfer of the center can be sufficiently prevented. In addition, generation of a non-uniform color density image caused by the concavo-convex shape and a stain on the back surface of the transfer medium P can be prevented. Furthermore, the durability can be improved.

Third Embodiment

According to a third embodiment, a transfer roller having an elastic layer formed of a solid rubber can stably convey paper sheets. Unlike the first embodiment in which the concave portions and the convex portions of the transfer roller linearly extend, concave portions and convex portions according to the third embodiment extend in the axis direction of the transfer roller in a curved shape. Note that the configuration of an image forming apparatus according to the third embodiment is similar to that of the first embodiment. Accordingly, the same reference numerals are used in both first and third embodiments to identify the same members, and description of the configuration is not repeated.

Figure 9A:
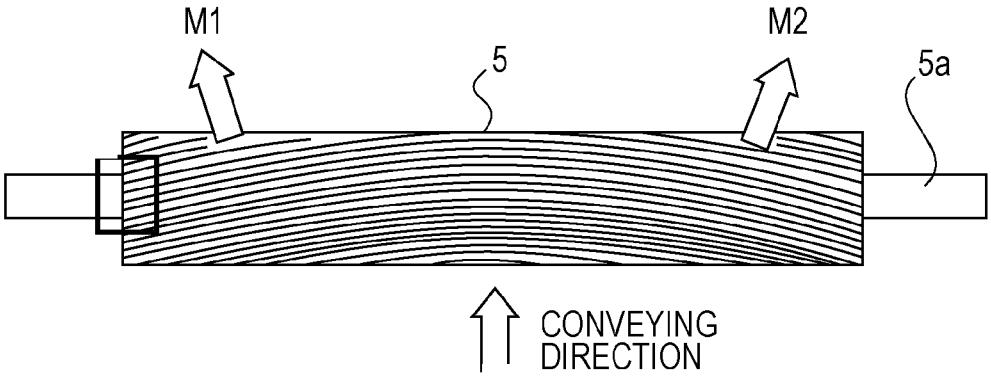
FIGS. 9A and 9B are schematic illustrations of an exemplary structure of a transfer roller according to a third embodiment.
Figure 9B:
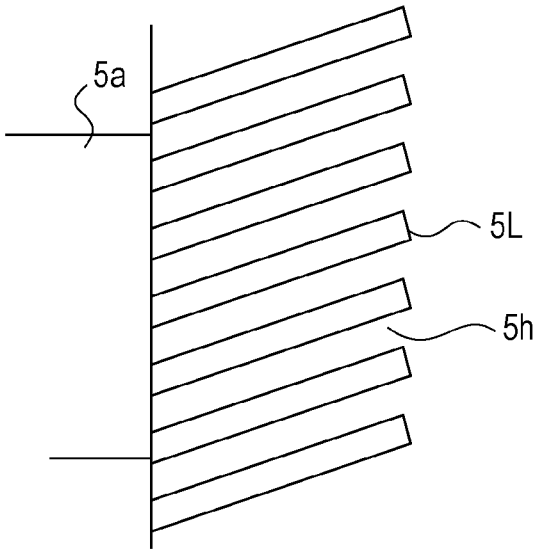

As shown in FIGS. 9A and 9B, curved concave portions 5*h* and convex portions 5L extending in the length direction are formed on the surface of the transfer roller 5. In order to realize such a shape, a die having a concavo-convex shape is rotated while the material is being extruded. In this way, the curved concave portions 5*h* and convex portions 5L extending in the axis direction of the transfer roller can be formed.

The concave portions 5*h* provides a plurality of recesses that extend in a concentric pattern in a direction in which the transfer medium P is conveyed. Accordingly, conveying power can be applied to the transfer medium P in directions M1 and M2 towards the end portions of the transfer roller 5 in the length direction at all times. Therefore, even when the transfer medium P absorbs moisture and is easily rippled, transfer defects and image artifacts caused by wrinkles or jamming can be prevented. The transfer medium P is conveyed while a skew of the transfer medium P (a paper sheet) is being corrected.

According to the present invention, any shape of the concavo-convex portion that provides appropriate bowing of the protrusions 5*j* and ensures an appropriate gap using the concave portions 5*e* can be used. That is, the shape of the concavo-convex portion is not limited to the shapes of the embodiments. For example, the shape may be triangular, rectangular, polygonal, semicircular, trapezoidal, or a tapered shape in which the top portion is wider than the base portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-262069 filed Nov. 17, 2009, which is hereby incorporated by reference herein in its entirety.

What is claimed is:

1. An image forming apparatus comprising:

an image bearing member configured to bear a toner image; and a transfer roller configured to face the image bearing member and form a transfer nip portion together with the image bearing member;

wherein the image forming apparatus transfers the toner image from the image bearing member onto a transfer medium conveyed into the transfer nip portion, and wherein the transfer roller includes a metal core bar and an elastic layer disposed on the metal core bar, the elastic layer is formed of solid rubber which does not foam by a foaming process, and the elastic layer includes, on a surface thereof, a plurality of convex portions each extending in a line in an axis direction of the transfer roller, and wherein a convex portion positioned at the transfer nip, among the plurality of convex portions, tilts such that a leading end of convex portion comes into contact with a neighboring convex portion when the toner image is transferred onto the transfer medium.

2. The image forming apparatus according to claim 1, wherein the following condition is satisfied:

$$D/W \geqq 0.7$$

where W denotes a center-to-center distance of the neighboring convex portions, and D denotes a length between a tangential line of the vertex of any one of the convex portions and a bottom of a concave portion.

3. The image forming apparatus according to claim 2, wherein W is smaller than or equal to 800 μm.

4. The image forming apparatus according to claim 3, wherein W is larger than or equal to 100 μm, and D is larger than or equal to 100 μm.

5. The image forming apparatus according to claim 4, wherein D is smaller than or equal to 1000 μm.

6. The image forming apparatus according to claim 1, wherein the line is a straight line.

7. The image forming apparatus according to claim 1, wherein the line is a curved line.

8. The image forming apparatus according to claim 1, wherein the elastic layer is formed from a solid rubber made of at least one of an ethylene-propylene rubber and a polypropylene resin, and the solid rubber is an elastic member produced through steps without a step of mixing blowing agents into the material and foaming the material in a molding stage, and wherein an Asker C hardness of the elastic layer is higher than or equal to 45 degrees and lower than or equal to 75 degrees.

9. A transfer roller for use in an image forming apparatus, the image forming apparatus including an image bearing member configured to bear a toner image and the transfer roller configured to face the image bearing member and form a transfer nip portion together with the image bearing member, the transfer roller transferring a toner image from the image bearing member onto a transfer medium conveyed to the transfer nip, the transfer roller comprising:

a metal core bar; and an elastic layer disposed on the metal core bar, the elastic layer being formed of solid rubber which does not foam by a foaming process;

wherein the elastic layer includes, on a surface thereof, a plurality of convex portions each extending in a line in an axis direction of the transfer roller, and wherein a convex portion positioned at the transfer nip, among the plurality of convex portions, tilts such that a leading end of convex portion comes into contact with a neighboring convex portion when the toner image is transferred onto the transfer medium.

10. The transfer roller according to claim 9, wherein the following condition is satisfied:

$$D/W \geqq 0.7$$

where W denotes a center-to-center distance of the neighboring convex portions, and D denotes a length between a tangential line of the vertex of any one of the convex portions and a bottom of a concave portion.

11. The transfer roller according to claim 10, wherein W is smaller than or equal to 800 μm.

12. The transfer roller according to claim 11, wherein W is larger than or equal to 100 μm, and D is larger than or equal to 100 μm.

13. The transfer roller according to claim 12, wherein D is smaller than or equal to 1000 μm.

14. The transfer roller according to claim 9, wherein the line is a straight line.

15. The transfer roller according to claim 9, wherein the line is a curved line.

16. The transfer roller according to claim 9, wherein the elastic layer is formed from a solid rubber made of at least one of an ethylene-propylene rubber and a polypropylene resin, the solid rubber is an elastic member produced through steps without a step of mixing blowing agents into the material and foaming the material in a molding stage, and wherein an Asker C hardness of the elastic layer is higher than or equal to 45 degrees and lower than or equal to 75 degrees.

17. An image forming apparatus comprising:

an image bearing member configured to bear a toner image; and a transfer roller configured to face the image bearing member and form a transfer nip portion together with the image bearing member, wherein the image forming apparatus transfers the toner image from the image bearing member onto a transfer medium conveyed into the transfer nip portion, and wherein the transfer roller includes a metal core bar and an elastic layer disposed on the metal core bar, the elastic layer is formed of solid rubber which does not foam by a foaming process, and the elastic layer includes, on a surface thereof, a plurality of convex portions each extending in a line in an axis direction of the transfer roller, wherein the following condition is satisfied:

$$D/W \geqq 0.7$$

where W denotes a center-to-center distance of the neighboring convex portions, and D denotes a length between a tangential line of the vertex of any one of the convex portions and a bottom of a concave portion, and wherein W is larger than or equal to 100 μm, and D is larger than or equal to 100 μm.

18. The image forming apparatus according to claim 17, wherein D is smaller than or equal to 1000 μm.

19. A transfer roller for use in an image forming apparatus, the image forming apparatus including an image bearing member configured to bear a toner image and the transfer roller configured to face the image bearing member and form a transfer nip portion together with the image bearing member, the transfer roller transferring a toner image from the image bearing member onto a transfer medium conveyed to the transfer nip, the transfer roller comprising:

a metal core bar; and an elastic layer disposed on the metal core bar, the elastic layer being formed of solid rubber which does not foam by a foaming process, wherein the elastic layer includes, on a surface thereof, a plurality of convex portions each extending in a line in an axis direction of the transfer roller.

wherein the following condition is satisfied:

$$D/W \geqq 0.7$$

where W denotes a center-to-center distance of the neighboring convex portions, and D denotes a length between a tangential line of the vertex of any one of the convex portions and a bottom of a concave portion, and wherein W is larger than or equal to 100 μm, and D is larger than or equal to 100 μm.

20. The transfer roller according to claim 19, wherein D is smaller than or equal to 1000 μm.

* * * * *